US006015052A

United States Patent [19]

Goldberg et al.

[11] Patent Number: 6,015,052

[45] Date of Patent: Jan. 18, 2000

[54] MODULAR SHELVING SYSTEM

[75] Inventors: Mark Goldberg, Lido Beach; Marc G. Block, Wantagh, both of N.Y.

[73] Assignee: Global Equipment Company a Division of Global Direct Mail, Port Washington, N.Y.

[21] Appl. No.: 08/939,585

[22] Filed: Sep. 29, 1997

[51] Int. Cl.[7] ..... A47F 5/00

[52] U.S. Cl. ..... 211/187; 108/106; 108/147.13; 211/181.1

[58] Field of Search ..... 211/187, 181.1; 108/106, 147.12, 147.13, 147.14; 248/243

[56] References Cited

U.S. PATENT DOCUMENTS

| | | | |
|---|---|---|---|
| D. 326,579 | 6/1992 | Leeds . | |
| 2,760,650 | 8/1956 | Franks . | |
| 2,897,978 | 8/1959 | Beckner . | |
| 3,138,123 | 6/1964 | Maslow . | |
| 3,208,408 | 9/1965 | Maslow . | |
| 3,306,466 | 2/1967 | Liston . | |
| 3,316,864 | 5/1967 | Maslow . | |
| 3,424,111 | 1/1969 | Maslow . | |
| 3,479,975 | 11/1969 | Ferdinand et al. . | |
| 3,523,508 | 8/1970 | Maslow . | |
| 3,757,705 | 9/1973 | Maslow . | |
| 4,079,678 | 3/1978 | Champagne | 108/106 X |
| 4,138,953 | 2/1979 | Tashman . | |
| 4,237,798 | 12/1980 | Welsch . | |
| 4,512,591 | 4/1985 | Plante . | |
| 4,582,001 | 4/1986 | Leikarts | 108/106 |
| 4,592,286 | 6/1986 | Trubiano . | |
| 4,615,278 | 10/1986 | Cabrelli . | |
| 4,627,543 | 12/1986 | Nicely . | |
| 4,629,077 | 12/1986 | Niblock . | |
| 4,637,323 | 1/1987 | Nicely . | |
| 4,706,576 | 11/1987 | James | 108/106 X |
| 4,750,626 | 6/1988 | Nicely . | |
| 4,799,818 | 1/1989 | Sudimak et al. . | |
| 4,811,670 | 3/1989 | Kolvites et al. . | |
| 4,892,044 | 1/1990 | Welsch . | |
| 4,960,308 | 10/1990 | Donaghy . | |
| 4,964,350 | 10/1990 | Kolvites et al. . | |
| 4,989,519 | 2/1991 | Welsch et al. . | |
| 5,127,342 | 7/1992 | Taylor | 108/147.13 |
| 5,415,302 | 5/1995 | Carlson et al. . | |
| 5,676,263 | 10/1997 | Chang | 211/187 |
| 5,683,004 | 11/1997 | Aho | 108/106 X |

FOREIGN PATENT DOCUMENTS

| | | |
|---|---|---|
| 1515478 | 3/1967 | France . |
| G 1138902 | 10/1962 | Germany . |
| G 9109395 U | 7/1991 | Germany . |
| 1 210 505 | 10/1970 | United Kingdom . |
| 1 224 830 | 3/1971 | United Kingdom . |
| 1 454 021 | 10/1976 | United Kingdom . |
| 2 190 282 | 11/1987 | United Kingdom . |
| 2 207 597 | 2/1989 | United Kingdom . |

*Primary Examiner*—Robert W. Gibson, Jr.
*Attorney, Agent, or Firm*—Stroock & Stroock & Lavan LLP

[57] ABSTRACT

A shelving system is provided which includes a polygonal shelf assembly, shelf supporting assemblies and post. The polygonal shelf assembly includes at least three bracket receiving sections. At least three shelf supporting assemblies are provided for supporting the polygonal shelf assembly. At least three posts are provided for releasably coupling to the at least three shelf supporting assemblies for supporting a polygonal shelf assembly. Each of the shelf supporting assemblies includes a collar and a support bracket. The support brackets have a shelf receiving section. When assembled, each of the collars are frictionally coupled to the at least three posts and each of the support brackets are frictionally engaged to the collars. The at least three bracket receiving sections of the polygonal shelf assemblies are then releasably coupled to the shelf receiving sections of the support brackets to form a shelving system that may be easily assembled and disassembled.

3 Claims, 4 Drawing Sheets

16
10
18
24
20
18
24
20
4
18
20
4
18
20
2
2

10
24
18
16
19
22
22
20
20
18
14
19
19
12

FIG. 4
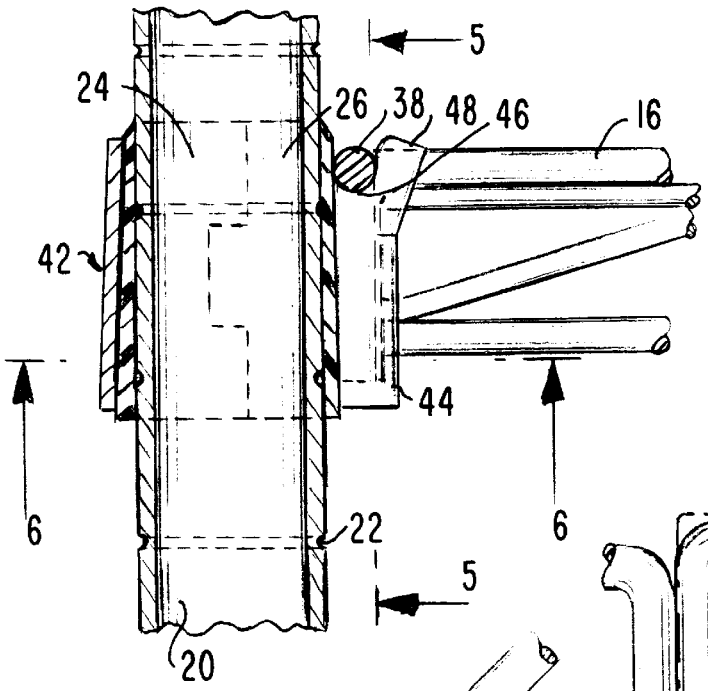
FIG. 5
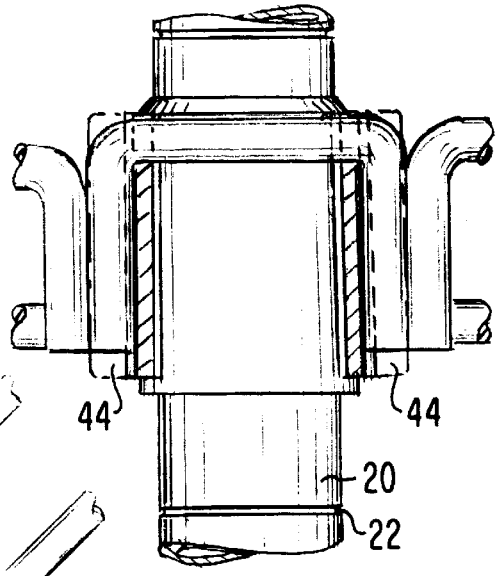
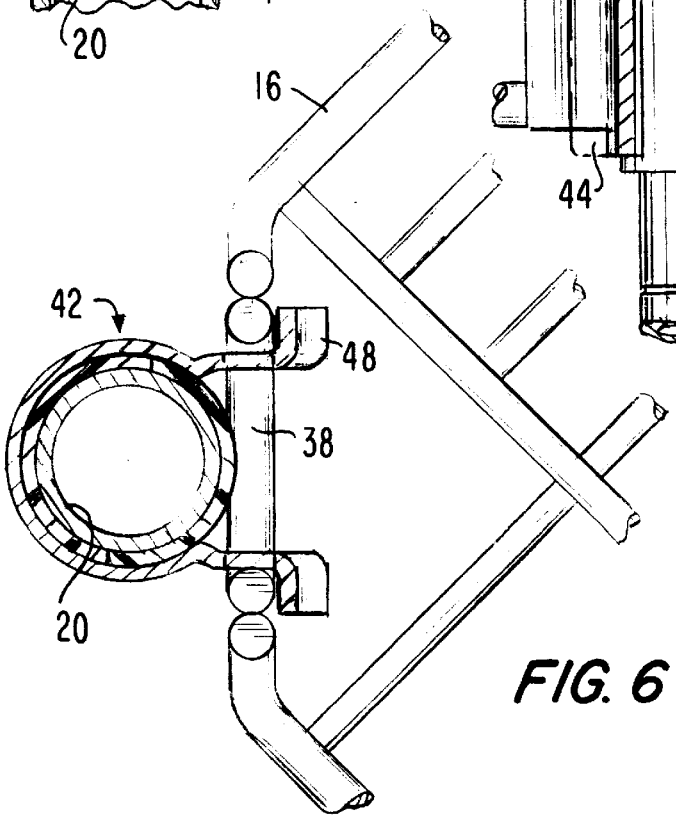
FIG. 6

MODULAR SHELVING SYSTEM

BACKGROUND OF THE INVENTION

This invention relates generally to a modular shelving system and, more particularly, to an improved modular shelving system which may be readily assembled and disassembled without tools to facilitate shipping, storing and cleaning.

Modular shelving systems are well known in the art. For example, U.S. Pat. Nos. 3,138,123 and 3,208,408 disclose knockdown shelving units; U.S. Pat. Nos. 3,424,111 and 3,523,508 disclose modular adjustable shelving systems; and U.S. Pat. No. 5,415,302 discloses a modular shelving system with a quick-change shelf feature. However, each of these shelves have drawbacks. The first four patents are not adjustable in the true sense in that they cannot be readily assembled and disassembled without tools or with great ease. The problem with U.S. Pat. No. 5,415,302 is that the adjustable feature may only be used for the intermediate shelves. That is, the top shelf assembly and the base shelf assembly must be releasably fixed to the post and it is difficult to disassemble. Similarly, U.S. Pat. No. 4,592,286 discloses an adjustable shelving structure, but is difficult to assemble and disassemble due to the support mechanism.

Accordingly, it is desired to develop a modular shelving system that allows for easy installation and removal of one or more shelves without requiring the disassembly of the entire shelving system.

SUMMARY OF THE INVENTION

Generally speaking, a shelving system is provided which includes a polygonal shelf assembly, shelf supporting assemblies and posts. The polygonal shelf assembly includes at least three bracket receiving sections. At least three shelf supporting assemblies are provided for supporting the polygonal shelf assembly. At least three posts are provided for releasably coupling to the at least three shelf supporting assemblies for supporting a polygonal shelf assembly. Each of the shelf supporting assemblies includes a collar and a support bracket. The support brackets have a shelf receiving section. When assembled, each of the collars are frictionally coupled to the at least three posts and each of the support brackets are frictionally engaged to the collars. The at least three bracket receiving sections of the polygonal shelf assemblies are then releasably coupled to the shelf receiving sections of the support brackets to form a shelving system that may be easily assembled and disassembled.

It is an object of the invention to provide an improved modular shelving system.

It is another object of the invention to provide an inexpensive, knockdown, modular shelving system that can be readily assembled and disassembled with minimal effort and without tools and it still have high strength, stability and rigidity.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taking in connection with the accompanying drawings, in which:

FIG. 4 is a fragmented, elevational view of the support post, support bracket, collar and truncated corners of the shelving system shown in FIG. 1;

FIG. 5 is a sectional view taking along line 5—5 of FIG. 4; and

FIG. 6 is a sectional view taking along line 6—6 of FIG. 4.

DETAILED DESCRIPTION OF THE PREFERRED EMBODIMENTS

For definitional purposes, the following terms will be used for referring to the fully assembled system in normal use. The term "horizontal" refers to the direction parallel to a surface on which the assembled shelving system is supported in normal use. The term "vertical" refers to a direction substantially perpendicular to the horizontal direction. The term "base" refers to the end of the shelving system closest to the surface on which the shelving system is supported. The term "top" refers to the end opposite the base. The terms "front," "rear," "left side" and "right side" of the shelving system are relative terms as well be defined below.

Figure 1:
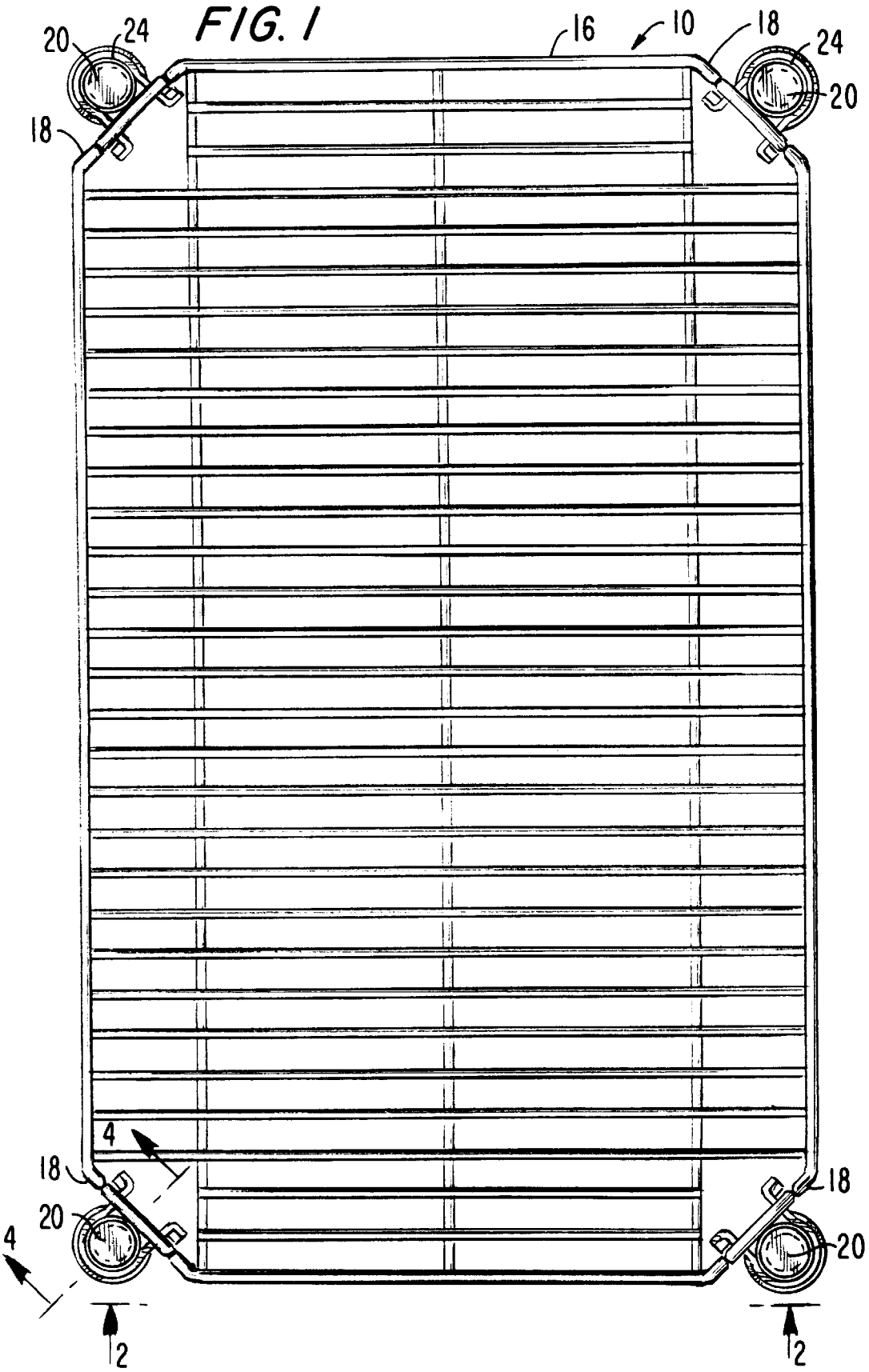
FIG. 1 is a top plan view of a shelf assembly in accordance with the invention.
Figure 2:
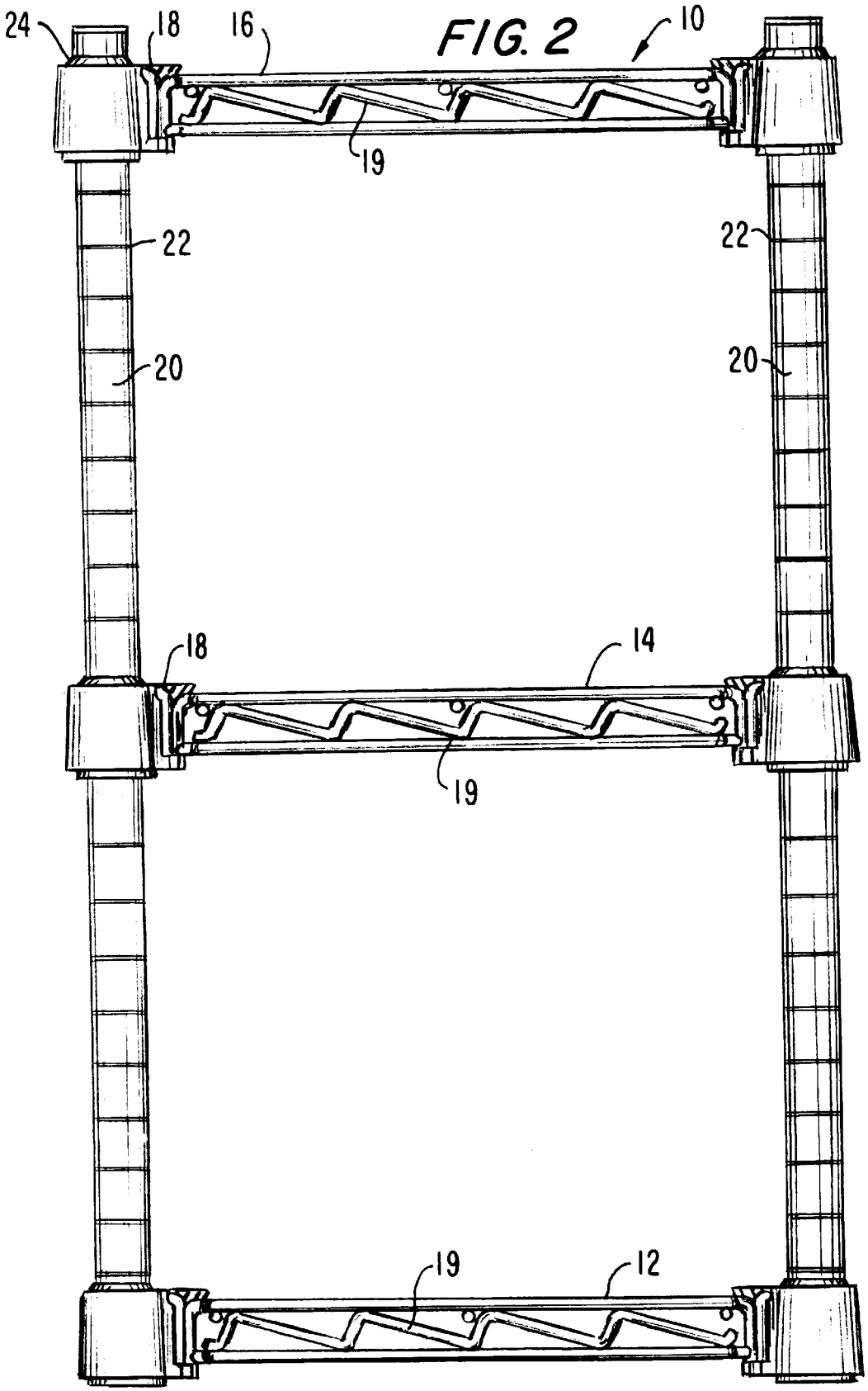
FIG. 2 is a side elevational view of the shelf assembly in accordance with the invention.

Referring to FIGS. 1 and 2, a preferred embodiment of a shelving system 10 is disclosed. While system 10 will be described in detail below, it generally comprises a first polygonal frame assembly serving as a base assembly 12, a second identical frame assembly 14 serving as an intermediate shelf assembly and a top identical frame assembly 15. While shelf assembly 14 is denoted as intermediate it may be positioned anywhere between base shelf 12 and top shelf 16. Moreover, additional intermediate shelves 14 may be placed between base shelf 12 and top shelf 16. Shelf 16 includes truncated corners 18 as best shown in FIG. 2. Similarly, base shelves 12 and 14 have the same truncated corners, not shown.

In the preferred embodiment of the invention, shelves 12, 14 and 16 are generally rectangular in shape and have a relatively long dimension running along the front and back and relatively short dimension running along the left and right sides of shelving system 10. A typical shelf assembly may have the dimension of 24" by 48" by 74". However, any size or shape of the shelves may be used. Shelves 12, 14 and 16 include snake trusses 19 which form the front and back thereof and extend essentially perpendicular thereto. Shelves 12, 14 and 16 as well as snake trusses 19 may be formed of bright basic steel. However, any number of wire sizes may be used depending on material cost, availability and the intended load of shelving system 10.

Figure 3:
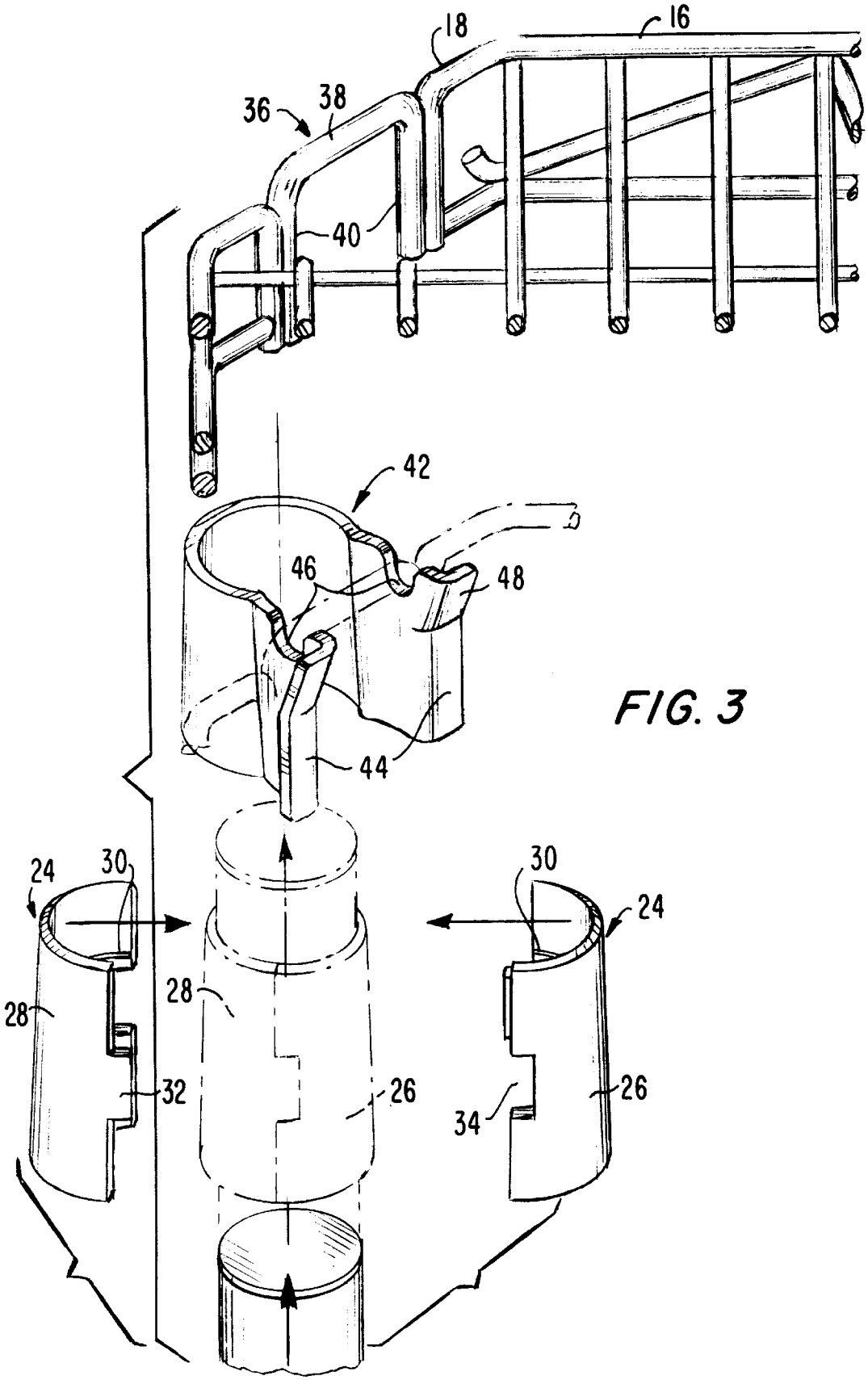
FIG. 3 is an exploded perspective view of the connecting members of the shelving assembly.

Truncated corners 18 of shelves 12, 14 and 16 include a bracket receiving section 36 as best shown in FIG. 3 and are positioned between snake trusses 19. Bracket receiving section 36 includes a mounting section 38 at its top and two mounting sections 38 essentially perpendicular to bracket receiving section 36. The end opposite bracket receiving section 36 is open for receiving a bracket 42 as well be explained below in greater detail.

Shelves 12, 14 and 16 are supported by posts 20. In the preferred embodiment, four posts 20 are used so as to correspond to each truncated corner 18. Support posts 20 are generally hollow and are typically made of lightweight metal which provides high structural rigidity and are inexpensive to manufacture. Further, the materials should be resistant to corrosion and easily cleaned. A plurality of circumferential grooves 22, spaced apart at substantial regular intervals, are formed on support posts 20. Grooves 22 interact with collars 24, as will be described below in greater detail.

Collar 24 is formed with a first half 26 and a second half 28 as best shown in FIG. 3. First half 26 and second half 28 are joined together by interlocking tab assembly 32 and 34. On the interior of first half 26 and second half 28 of collar 24 is a lip 30. Lip 30 is positioned about the interior circumference of collar 24. Lip 30 is provided to interact with grooves 22 of post 20. When first half 26 is connected through interlocking tab assembly 32 and 34 to second half 28, collar 24 takes on a frustoconical shape. At the same time, lip 30 frictionally engages groove 22 so as to hold collar 24 in place. Each collar 24 is arranged so as to taper outwardly, when shelving system 10 is positioned in normal use. Collar 24 may be fabricated of any metal, but in the preferred embodiment, it is constructed using a plastic.

Bracket 42, as best shown in FIG. 3, is used to connect shelves 12, 14 and 16 to posts 20 and will be described below in greater detail. Brackets 42 are generally U-shaped with load support ends 44 extending from each end and are essentially perpendicular to the U-shaped portion of support bracket 42. At the top end of support bracket 42 is a shelf receiving section 46. Shelf receiving section 46 is shaped to fit mounting section 38 of bracket receiving section 36 of shelves 12, 14 or 16. In the preferred embodiment, shelf receiving sections 46 are semi-circular with notches 48 extending therefrom.

The assembly of shelving system 10 will now be described in connection with assembling base shelf 14 to posts 20. However, the same steps are repeated for intermediate shelf 14 and top shelf 16 or any other shelves that are added therebetween.

To assemble shelving system 10, reference is made to FIGS. 3, 4, 5 and 6. Collars 24 are placed on posts 20 at the desired location. That is, each collar 24 is placed on a groove 22 on a corresponding post 20 at the same height so that shelf 12 will be level when assembled. To attach collar 24 to post 20, lip 30 of first half 26 and second half 28 are aligned with a groove 22 of post 20. The interlocking tab assembly 32 and 34 are then snapped together so that collar 24 securely fits around post 20 and is locked thereto through frictional engagement. The same step is repeated for each of the other three posts 20.

Support bracket 22 is next placed above collar 24 on post 20 then pulled toward the surface to a position as best shown in FIG. 5. The interior volume of support bracket 42, which takes on a modified frustroconical shape, is slightly greater than the frustroconical shape of collar 24 so that a friction fit is formed between the two parts. Support bracket 42 is pulled downward so that the top portion of collar 24 extends above support bracket 42. A support bracket 42 for each of the other three posts 20 are positioned in the same manner as described above.

Next, base shelf 12 is connected to posts 20 on support bracket 42. To make this connection, truncated corner 18 of base shelf 16 is aligned with support bracket 42. In particular, mounting section 38 of bracket receiving section 36 is aligned with shelf receiving section 46. Mounting section 38 is push downward into shelf receiving section 36. This step is repeated for each of the truncated comers 18 with respect to each corresponding support bracket 42. Once base shelf 12 is pushed downward, support wall 40 of bracket receiving section 36 rests against load support ends 44 as best shown in FIGS. 4 through 6. Notches 48 of support bracket 42 extend beyond mounting section 38 as shown in FIG. 4. This step is repeated for intermediate shelf 14 and top shelf 16.

To remove shelves 12, 14 and 16 from shelving system 10, each shelf assembly 12, 14 and 16 is lifted upward and away from the surface so that mounting section 38 of bracket receiving section 36 of truncated corners 18 are removed from shelf receiving section 46 of support bracket 42. Bracket receiving section 36 is then lifted in an direction away from the surface from collar 24 and is removed. Interlocking tab assemblies 32 and 34 are then released so that collar 24 may be removed. Based thereon, an inexpensive, lightweight vertical shelving system capable of being very easily assembled and disassembled is provided.

Moreover, the shelving assembly 10 could be designed so that any number of the shelves could be fix to posts 20 in a manner well known in the art, for example, that described in U.S. Pat. Nos. 3,424,111; 3,523,508; and 3,757,705. The user could then use the adjustable shelving mechanism, as described herein, using shelves 12, 14 or 16 with truncated corners 18 together with collars 24 and support bracket 42. In this manner, shelving assembly 10 would have a combination of fixed shelves and adjustable shelves. Alternatively, shelving system 10 could contain a plurality of adjustable shelves as shown in FIGS. 1 and 2.

All specific shapes, dimensions, wire sizes, number of shelves and materials mentioned herein are provided by way of example only. Shelving systems fabricated in shapes, dimensions and using different wire sizes and materials and having a different number of shelves other than those discussed and illustrated herein also are contemplated.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A shelving system, comprising:

a polygonal shelf assembly having at least three bracket receiving sections;

at least three shelf supporting assemblies for supporting said polygonal shelf assembly;

at least three posts being releasably coupled to said at least three shelf supporting assemblies for supporting said polygonal shelf assembly;

each of said shelf supporting assemblies including a collar and a support bracket, said support brackets having a shelf receiving section, each of said collars being frictionally coupled to said at least three posts, each of said support brackets being frictionally engaged to said collars, said at least three bracket receiving sections of said polygonal shelf assemblies being releasably coupled to said shelf receiving sections of said support brackets;

said support brackets being generally U-shaped and including a shelf receiving section and load support ends, said load support ends extending essentially from each of the ends of said U-shaped member; and said bracket receiving section of said shelf assembly extending substantially perpendicular to said shelf assembly and including a mounting section and at least two support walls, said mounting section being essentially parallel to said shelf assembly and said two support walls being substantially perpendicular to said shelf assembly, said mounting section of said bracket receiving section being releasably coupled to said receiving section of said support brackets and said two support walls being rested against said load support ends of said support brackets.

2. A shelving system, comprising:

a polygonal shelf assembly having at least three bracket receiving sections;

at least three shelf supporting assemblies for supporting said polygonal shelf assembly;

at least three posts being releasably coupled to said at least three shelf supporting assemblies for supporting said polygonal shelf assembly;

each of said shelf supporting assemblies including a collar and a support bracket, said support brackets having a shelf receiving section, each of said collars being frictionally coupled to said at least three posts, each of said support brackets being frictionally engaged to said collars, said at least three bracket receiving sections of said polygonal shelf assemblies being releasably coupled to said shelf receiving sections of said support brackets;

said at least three posts including a plurality of substantially circumferential grooves spaced at essentially regular intervals;

said collars of said shelf supporting assemblies including a substantially circumferential lip in the interior surface for frictional engagement with the circumferential grooves of said posts;

said polygonal shelf assembly being substantially rectangular and including substantially truncated corners, each of said truncated corners including said bracket receiving sections;

said support brackets being generally U-shaped and including a shelf receiving section and load support ends, said load support ends extending essentially from each of the ends of said U-shaped member; and said bracket receiving section of said shelf assembly extending substantially perpendicular to said shelf assembly and including a mounting section and at least two support walls, said mounting section being essentially parallel to said shelf assembly and said two support walls being substantially perpendicular to said shelf assembly, said mounting section of said bracket receiving section being releasably coupled to said receiving section of said support brackets and said two support walls being rested against said load support ends of said support brackets.

3. A shelving system, comprising:

a polygonal shelf assembly having at least three bracket receiving sections;

at least three shelf supporting assemblies for supporting said polygonal shelf assembly;

at least three posts being releasably coupled to said at least three shelf supporting assemblies for supporting said polygonal shelf assembly;

each of said shelf supporting assemblies including a collar and a support bracket said support brackets having a shelf receiving section, each of said collars being frictionally coupled to said at least three posts, each of said support brackets being frictionally engaged to said collars, said at least three bracket receiving sections of said polygonal shelf assemblies being releasably coupled to said shelf receiving sections of said support brackets;

said at least three posts including a plurality of substantially circumferential grooves spaced at essentially regular intervals;

said collars of said shelf supporting assemblies including a first part and a second part the first part being releasably coupled to said second part to form a frustroconical shaped collar, the interior portion of said first and second parts include a substantially circumferential lip surface for frictional engagement with the circumferential grooves of said posts;

said polygonal shelf assembly being substantially rectangular and including substantial truncated corners, each of said truncated corners including said bracket receiving sections;

said support brackets being generally U-shaped and including a shelf receiving section and load support ends, said load support ends extending essentially from each of the ends of said U-shaped member; and said bracket receiving section of said shelf assembly extending substantially perpendicular to said shelf assembly and including a mounting section and at least two support walls, said mounting section being essentially parallel to said shelf assembly and said two support walls being substantially perpendicular to said shelf assembly, said mounting section of said bracket receiving section being releasably coupled to said receiving section of said support brackets and said two support walls being rested against said load support ends of said support brackets.

* * * * *